US008814284B2

(12) United States Patent
Lee et al.

(10) Patent No.: US 8,814,284 B2
(45) Date of Patent: Aug. 26, 2014

(54) REFRIGERATOR

(75) Inventors: Su-Won Lee, Gyeongsangnam-do (KR); Kyung-Eun Lee, Seoul (KR); Han Rim Song, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/319,752

(22) PCT Filed: Sep. 3, 2009

(86) PCT No.: PCT/KR2009/004967

§ 371 (c)(1),
(2), (4) Date: Nov. 10, 2011

(87) PCT Pub. No.: WO2010/131813

PCT Pub. Date: Nov. 18, 2010

(65) Prior Publication Data

US 2012/0062093 A1 Mar. 15, 2012

(30) Foreign Application Priority Data

May 12, 2009 (KR) ..... 10-2009-0041056

(51) Int. Cl.
*A47B 91/00* (2006.01)
*A47B 96/04* (2006.01)

(52) U.S. Cl.
USPC ..... 312/291; 312/405

(58) Field of Classification Search
USPC ..... 312/291, 401, 402, 405, 405.1
See application file for complete search history.

(56) References Cited

U.S. PATENT DOCUMENTS

| | | | | | |
|---|---|---|---|---|---|
| 1,927,398 | A | * | 9/1933 | Glasser | 62/377 |
| 2,046,909 | A | | 7/1936 | Terry et al. | |
| 2,051,132 | A | * | 8/1936 | Dart | 62/441 |
| 2,095,811 | A | | 10/1937 | Goulooze | |
| 2,112,771 | A | | 3/1938 | Goulooze | |
| 2,122,680 | A | | 7/1938 | Dart | |
| 2,129,923 | A | * | 9/1938 | Frankel | 312/236 |
| 2,130,617 | A | | 9/1938 | Dockham | |
| 2,131,680 | A | | 9/1938 | Zahodiakin | |
| 2,135,878 | A | * | 11/1938 | Sekyra, Sr. | 62/252 |
| 2,150,064 | A | * | 3/1939 | John et al. | 62/266 |
| 2,213,274 | A | | 9/1940 | Flamm | |
| 2,276,937 | A | * | 3/1942 | Cordova | 222/130 |
| 2,692,813 | A | | 10/1954 | Toronto | |
| 3,140,134 | A | * | 7/1964 | Nairn | 312/204 |

(Continued)

FOREIGN PATENT DOCUMENTS

| | | | |
|---|---|---|---|
| CN | 1627016 | A | 6/2008 |
| EP | 0 539 558 | A1 | 12/1992 |

(Continued)

OTHER PUBLICATIONS

PCT International Search Report dated May 24, 2010 for Application No. PCT/KR2009/004967, with English translation, 4 pages.

(Continued)

*Primary Examiner* — Darnell Jayne
*Assistant Examiner* — Timothy M Ayres
(74) *Attorney, Agent, or Firm* — Fish & Richardson P.C.

(57) ABSTRACT

The present embodiment relates to a refrigerator. With the present embodiment, a user can easily draw in and out foods stored in a storage chamber.

15 Claims, 12 Drawing Sheets

(56) References Cited

U.S. PATENT DOCUMENTS

| | | | | |
|---|---|---|---|---|
| 3,218,111 | A | 11/1965 | Steiner | |
| 3,389,424 | A | 6/1968 | Fellwock | |
| 3,510,986 | A | 5/1970 | Berkowitz | |
| 4,087,140 | A | 5/1978 | Linstromberg | |
| 4,302,907 | A | 12/1981 | Canals et al. | |
| 4,368,622 | A | 1/1983 | Brooks | |
| 4,514,021 | A | 4/1985 | Sundermeier et al. | |
| 5,209,082 | A | 5/1993 | Ha | |
| 5,966,963 | A | 10/1999 | Kovalaske | |
| 6,055,823 | A | 5/2000 | Baker et al. | |
| 6,268,594 | B1 | 7/2001 | Leutner et al. | |
| 6,375,291 | B1 | 4/2002 | Nam et al. | |
| 7,008,032 | B2 | 3/2006 | Chekal | |
| 7,410,229 | B2 * | 8/2008 | Pohl et al. | 312/407 |
| 2005/0188506 | A1 | 9/2005 | Lee et al. | |
| 2005/0258724 | A1 | 11/2005 | Hwa | |
| 2006/0005484 | A1 | 1/2006 | Riblier et al. | |
| 2006/0179869 | A1 | 8/2006 | Lee | |
| 2006/0265979 | A1 | 11/2006 | Cording | |
| 2007/0018548 | A1 * | 1/2007 | Ertz et al. | 312/402 |
| 2008/0168794 | A1 | 7/2008 | Cho | |
| 2010/0107679 | A1 * | 5/2010 | Park et al. | 62/441 |

FOREIGN PATENT DOCUMENTS

| | | | |
|---|---|---|---|
| FR | 2191084 | A1 | 2/1974 |
| JP | 56-164495 | U | 12/1981 |
| JP | 63-142682 | U | 9/1988 |
| JP | 06-066473 | A | 3/1994 |
| JP | 10-009757 | A | 1/1998 |
| JP | 11-237173 | A | 8/1999 |
| JP | 2000-065459 | A | 3/2000 |
| JP | 2000-304437 | A | 11/2000 |
| JP | 2001-108357 | A | 4/2001 |
| JP | 2002-323287 | A | 11/2002 |
| JP | 2004-211977 | A | 7/2004 |
| JP | 2006-038437 | A | 2/2006 |
| JP | 2009-103395 | A | 5/2009 |
| KR | 1990-0008203 | Y1 | 9/1990 |
| KR | 1996-0011364 | A | 4/1996 |
| KR | 20-1999-037440 | U | 5/1999 |
| KR | 10-1999-0042339 | A | 6/1999 |
| KR | 1999-042339 | A | 6/1999 |
| KR | 1999-062159 | A | 7/1999 |
| KR | 20-1999-0037440 | U | 10/1999 |
| KR | 1999-037440 | A | 10/1999 |
| KR | 20-1999-0039593 | U | 11/1999 |
| KR | 1999-0039593 | A | 11/1999 |
| KR | 20-0164322 | Y1 | 2/2000 |
| KR | 20-0168373 | Y1 | 2/2000 |
| KR | 2002-0083115 | A | 11/2002 |
| KR | 10-2003-0021943 | A | 3/2003 |
| KR | 10-0376167 | B1 | 3/2003 |
| KR | 20-0314145 | Y1 | 5/2003 |
| KR | 10-2003-0083813 | A | 11/2003 |
| KR | 2003-0083812 | A | 11/2003 |
| KR | 2003-0083813 | A | 11/2003 |
| KR | 2004-0094456 | A | 11/2004 |
| KR | 2005-0111094 | A | 11/2005 |
| KR | 10-0596533 | B1 | 7/2006 |
| KR | 10-0733309 | B1 | 6/2007 |
| KR | 10-0887575 | B1 | 3/2009 |
| KR | 2009-0077564 | A | 7/2009 |
| RU | 2321808 | C2 | 4/2008 |
| WO | WO 2004/015344 | A1 | 2/2004 |
| WO | WO 2004/059228 | | 7/2004 |

OTHER PUBLICATIONS

Chinese Office Action dated Feb. 5, 2013 for Application No. 200980159127.5, with English Translation, 9 pages.

Russian Office Action dated Jan. 16, 2013 for Application No. 2011139999, in English, 4 pages.

U.S. Office Actions dated Mar. 29, 2013 for U.S. Appl. No. 13/391,632, 10 pages.

European Search Report dated May 15, 2014 for Application No. 09844687, 4 pages.

* cited by examiner

REFRIGERATOR

CROSS REFERENCE TO RELATED APPLICATIONS

The present application claims priority under 35 U.S.C. 119 and 35 U.S.C. 365 to Korean Patent Application No. 10-2009-0041056 (filed on May 12, 2009), which is hereby incorporated by reference in its entirety.

BACKGROUND OF THE INVENTION

1. Field of the Invention

The embodiment relates to a refrigerator.

2. Description of the Related Art

Generally, a refrigerator is an apparatus that stores foods in a low-temperature state.

The refrigerator includes a main body in which a storage chamber is formed and doors that are movably connected to the main body to open and close the storage chamber.

The storage chamber may be partitioned into a refrigerating chamber and a freezing chamber and the doors includes a refrigerating chamber door that opens and closes the refrigerating chamber and a freezing chamber door that opens and closes the freezing chamber.

Therefore, a user should open the freezing chamber door or the refrigerating chamber door in order to draw out foods stored in the refrigerating chamber or the freezing chamber.

SUMMARY OF THE INVENTION

It is an object of the embodiment to provide a refrigerator capable of taking out foods stored in a storage chamber with a little force.

There is provided a refrigerator according to one embodiment, including: a main body in which a first storage chamber is formed; a housing that forms a second storage chamber selectively received inside the first storage chamber; a first door that includes the housing and opens and closes the first storage chamber; and a second door that is movable with respect to the first door and opens and closes the second storage chamber.

There is provided a refrigerator according to another embodiment, including: a main body in which the first storage is formed; a housing that forms a second storage chamber selectively received inside the first storage chamber; a door that opens and closes the second storage chamber; and a coupling apparatus that selectively couples the door and the housing, wherein the door opens and closes the second storage chamber in the state where the door and the housing are separated from each other and the housing moves together with the door in the state where the door and the housing are coupled with each other.

With the embodiment, a separate sub-door is provided at the refrigerating chamber door, such that the user can open the sub-door without opening the refrigerating chamber door to draw out necessary foods, making it possible to increase the user convenience.

In addition, when the sub-door forms the entire external appearance of the front surface of the refrigerator door, the finishing is improved.

Further, when the refrigerating chamber or the freezing chamber, which are formed at the door, are selectively positioned inside the freezing chamber or the refrigerating chamber formed at the main body, the volume of the freezing chamber or the refrigerating chamber, which are formed at the main body, can be maximally secured.

DETAILED DESCRIPTION OF THE PREFERRED EMBODIMENTS

Hereinafter, embodiments will be described in detail with reference to the accompanying drawings.

Figure 1:
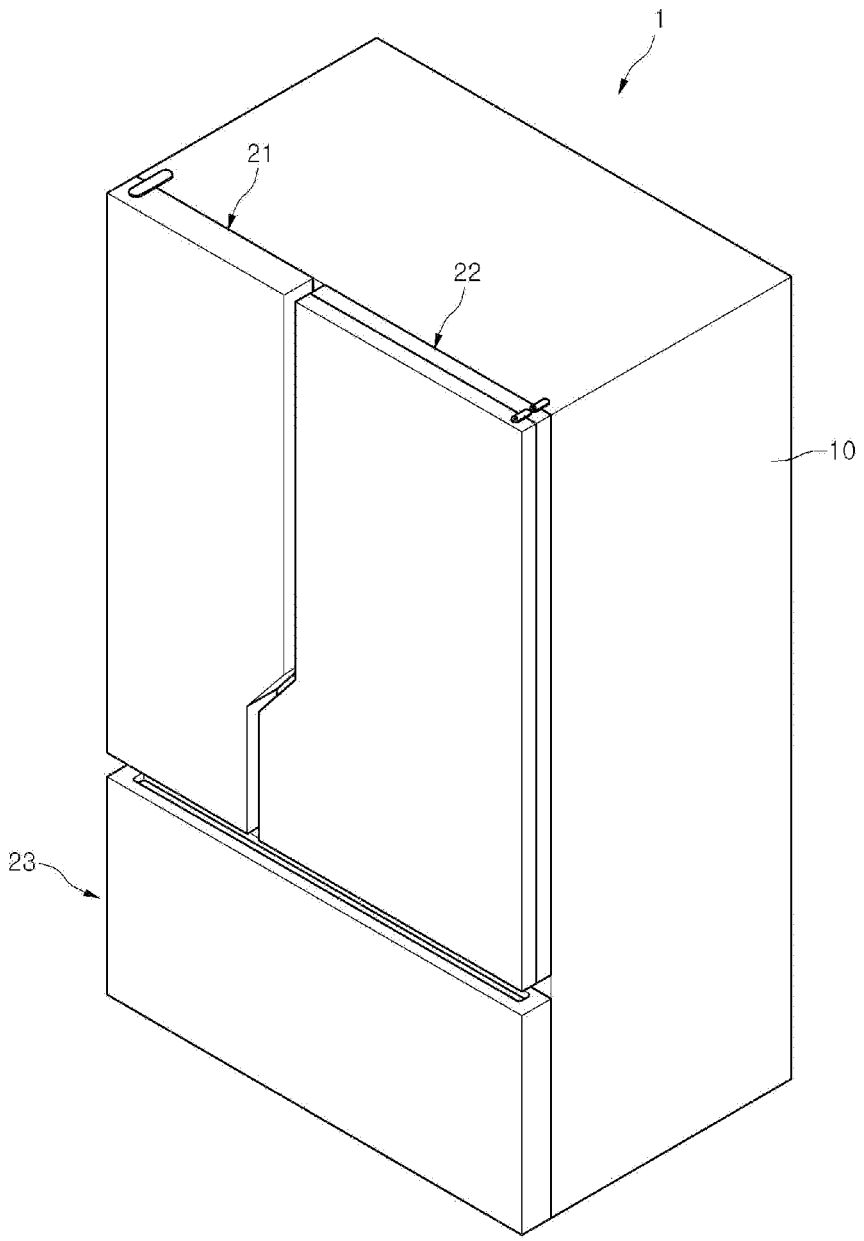
FIG. 1 is a perspective view of a refrigerator according to a first embodiment.
Figure 2:
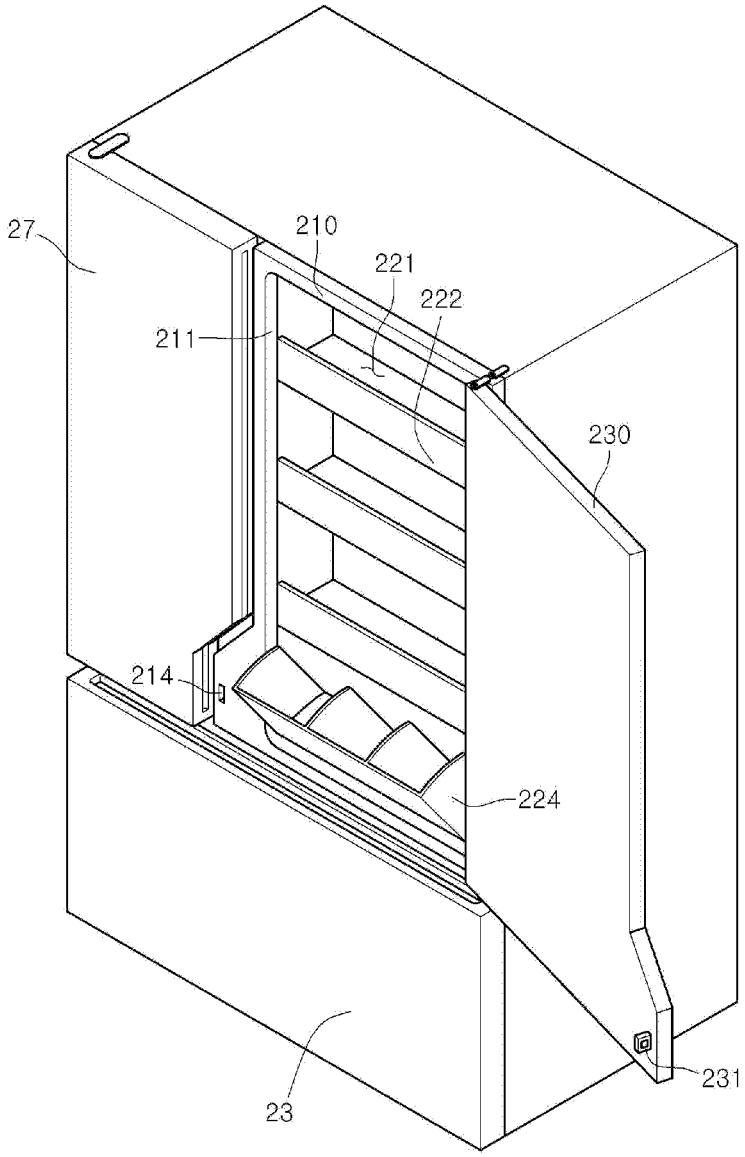
FIG. 2 is a perspective view of a refrigerator in the state where a sub-door according to the first embodiment is opened.
Figure 3:
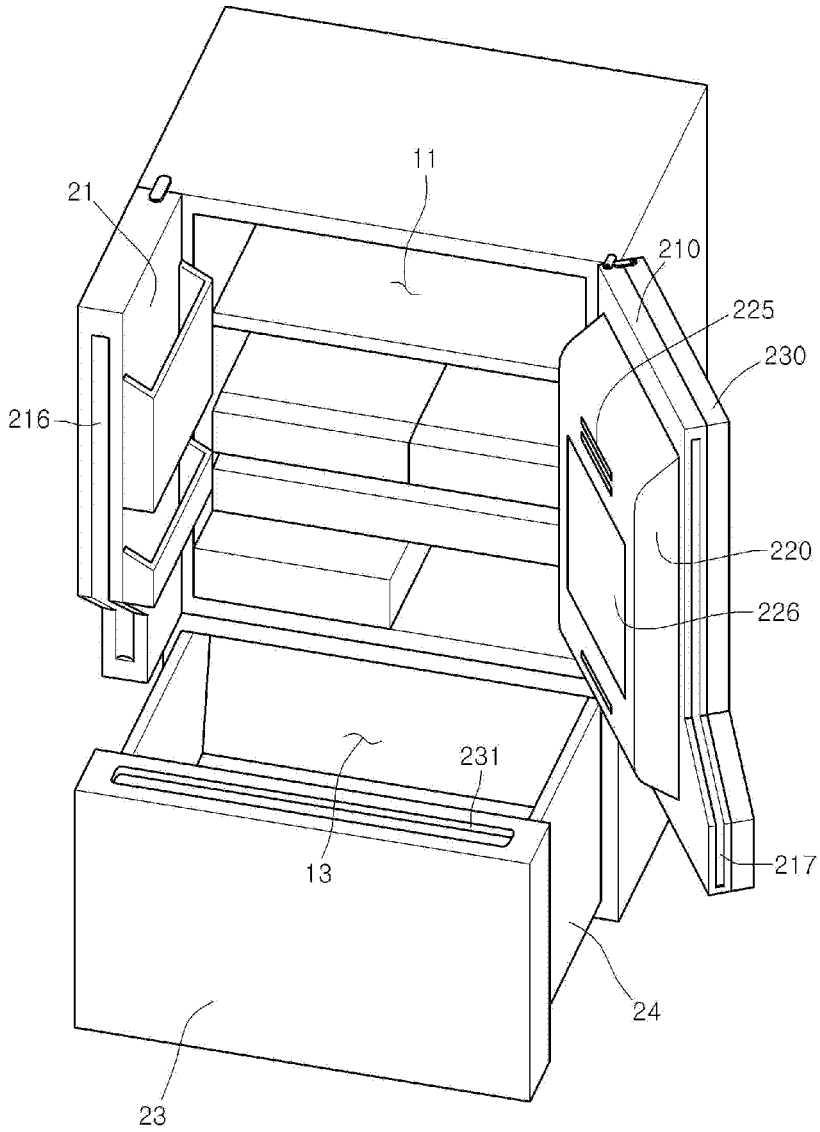
FIG. 3 is a perspective view of a refrigerator in the state where a refrigerating chamber door and a freezing chamber door according to the first embodiment are opened.

FIG. 1 is a perspective view of a refrigerator according to a first embodiment, FIG. 2 is a perspective view of a refrigerator in the state where a sub-door according to the first embodiment is opened, and FIG. 3 is a perspective view of a refrigerator in the state where the refrigerating chamber door and the freezing chamber door according to the first embodiment are opened.

Referring to FIGS. 1 to 3, a refrigerator 1 according to the present invention includes a main body 10 in which a storage chamber is formed and doors that open and close the storage chamber.

The storage chamber includes a refrigerating chamber 11 that is formed at an upper side portion of the main body and a freezing chamber 13 that is formed at the lower side portion of the main body 10 and is partitioned from the refrigerating chamber 11.

The doors includes a plurality of refrigerating chamber doors 21 and 22 that open and close the refrigerating chamber 11 and a freezing chamber door 23 that opens and closes the freezing chamber 13.

The plurality of refrigerating chamber doors 21 and 22 are rotatably connected to the main body 10, by way of example and the freezing chamber door 23 is connected to the main body 10 to be slidably drawn in or drawn out, by way of example.

The refrigerating chamber 11 has a single space or may be partitioned by one or more partitioning part. In the present embodiment, the refrigerating chamber 11, which is formed at the main body 10, may be referred to as a "main refrigerating chamber".

Any one 22 (a right door as one example in the present embodiment) of the plurality of refrigerating chamber doors 21 and 22 is provided with a main door 210 (referred to as a first door) that opens and closes a portion of the main refrigerating chamber 11, a sub-door 230 (referred to as a second door) that is rotatably coupled to the main door 210, and a housing 220 that defines a sub refrigerating chamber 221.

The housing 220 is coupled to a rear surface of the main door 210.

Therefore, the housing 220 is rotated together with the main door 210 when the main door 210 is rotated.

In the present embodiment, the housing 220, which forms the sub-refrigerating chamber 221, moves together with the main door 210, such that the sub-refrigerating chamber 221 may be formed at the refrigerating chamber door 22 (in particular, main door 210).

Therefore, in the present embodiment, the main refrigerating chamber 11 can be opened and closed by the left door 21 and the right door 22 (or main door) and the sub-refrigerating chamber 221 can be opened and closed by the sub-door 230.

The sub-refrigerating chamber 221 defined by the housing 220 may include a plurality of receiving parts 222 and 224.

The housing 220 may be provided with one or more cool air injecting hole 225 that injects cool air into the main refrigerating chamber 11. In addition, the housing 220 may be provided with a cover 226 that draws in and out foods stored in the sub-refrigerating chamber 221 in the state where the refrigerating chamber door 22 is opened.

The main door 210 is provided with an opening part 211 that draws out and in foods received in the sub-refrigerating chamber 221. The user can draw in or out foods stored in the sub-refrigerating chamber 221 through the opening part 211.

The sub-door 230 forms the entire external appearance of the front surface of the right door 22.

The sub-door 230 is provided with a guide part 231 that facilitates the door operation of the user. The guide part 231 is extended to a side portion from the side surface of the sub-door 230. The main door 210 also includes a protruding part 212 having a shape corresponding to the guide part 231.

The rear surface of the guide part 231 is formed with a latch hook 232 for coupling with the main door 210 and the protruding part 212 of the main door 210 is formed with a latch slot 214 with which the latch hook 232 is coupled.

The structure of the latch hook 232 and the latch slot 214 can use the known structure and therefore, the detailed description thereof will be omitted.

Therefore, when the front surface of the guide part 231 is pressed in the state where the sub-door 230 is closed, the coupling of the latch hook 232 and the latch slot 214 is released, such that the sub door 230 is opened. On the other hand, when the sub-door 230 is rotated and closed, the latch hook 232 and the latch slot 214 are coupled with each other.

Each of the side surfaces of the left door 21 and the main door 210 is formed with door grooves 216 and 217 for providing handles.

Therefore, in order to open the left door 21 or the main door 210 (or right door), the user pulls the doors 21 and 210 in the state where his/her fingers put in the door grooves 216 and 217.

Although not shown, the rear surface of the left door 21, the rear surface of the main door 210, and the rear surface of the sub-door 230 may be provided with a sealer for sealing.

Meanwhile, the rear surface of the freezing chamber door 23 can be coupled with a basket 24 for receiving foods. The upper surface of the freezing chamber door 23 may be provided with the door groove 231 for providing the handle.

The sub-refrigerating chamber 221 may receive frequently used foods or foods for children, etc., by way of examples. In this case, the user opens the sub-door 230 without opening the refrigerating chamber door 22 to draw out necessary foods, thereby increasing the user convenience.

In other words, force opening the sub-door 230 is weaker than force opening the refrigerating chamber door including the main door 210 and the sub-door 230, such that the user can draw out foods received in the sub-refrigerating chamber 221 with a little force.

Figure 4:
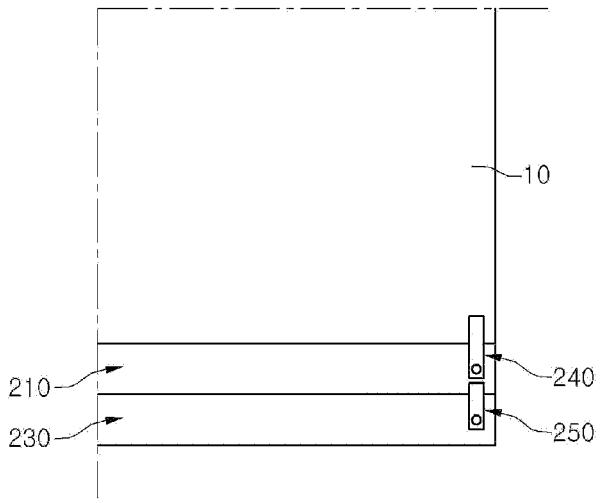
FIG. 4 is a partial plan view of the refrigerator according to the first embodiment.

FIG. 4 is a partial plan view of the refrigerator according to the first embodiment.

Referring to FIGS. 3 and 4, the main door 210 is disposed at the front of the main body 10 and the sub-door 230 is disposed at the front of the main door 210.

In other words, when viewed from the upper surface of the refrigerator, the main door 210 and the sub-door 230 are disposed in a row in front and rear directions.

The main door 210 can be rotated with respect to the main body by the first hinge assembly 240 and the sub-door 230 can be rotated with respect to the main body and the main door 210 by the second hinge assembly 250.

As shown in the drawings, the hinge centers of each hinge assembly 240 and 250 are spaced from each other.

Therefore, the main door 210 and the sub-door 230 can be rotated independently without interference with each other by each of the hinge assemblies 240 and 250.

In addition, the rotational center of each of the hinge assemblies 240 and 250 is extended in the upper and lower directions of the refrigerator. Therefore, the main door 210 and the sub-door 230 can be horizontally rotated based on the rotational center that is vertically extended.

Figure 5:
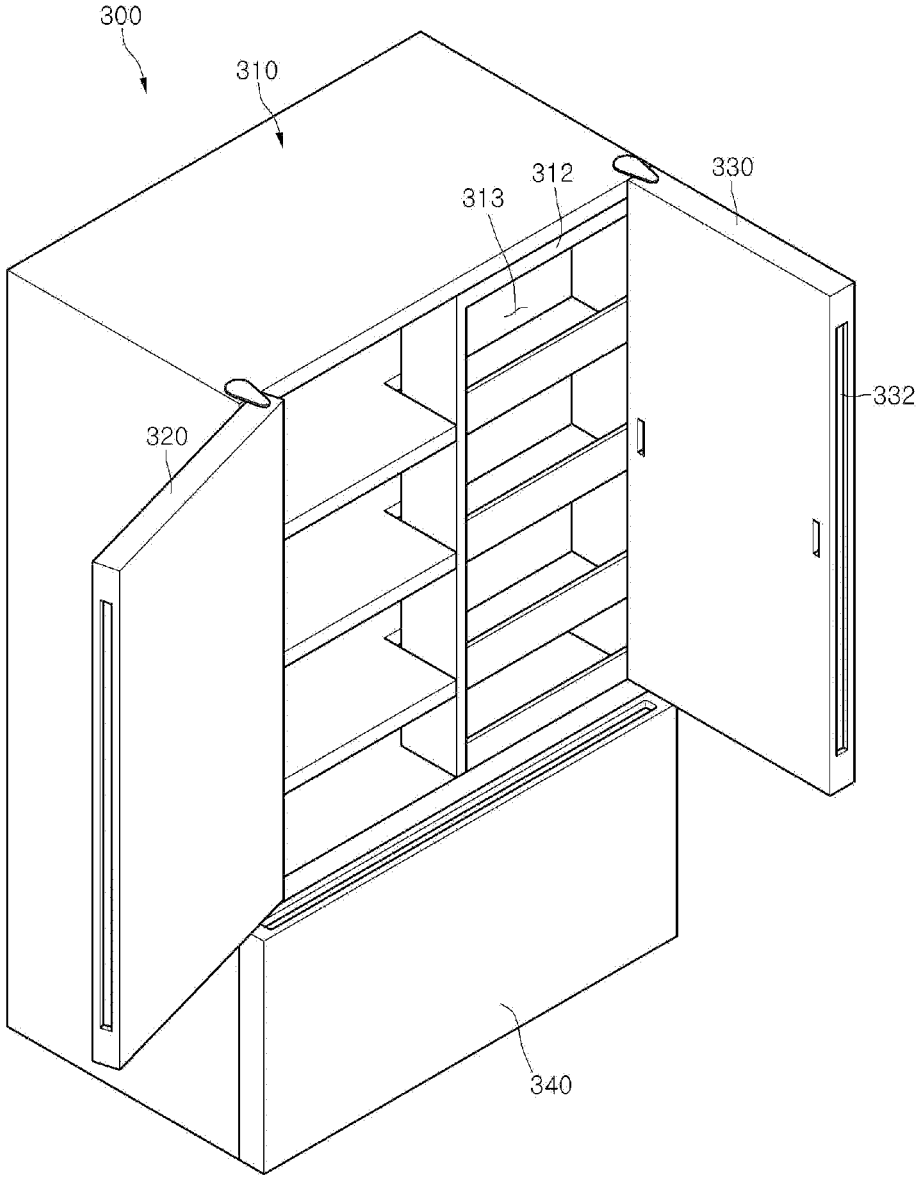
FIG. 5 is a perspective view of a refrigerator in the state where only a refrigerator door according to a second embodiment is opened.
Figure 6:
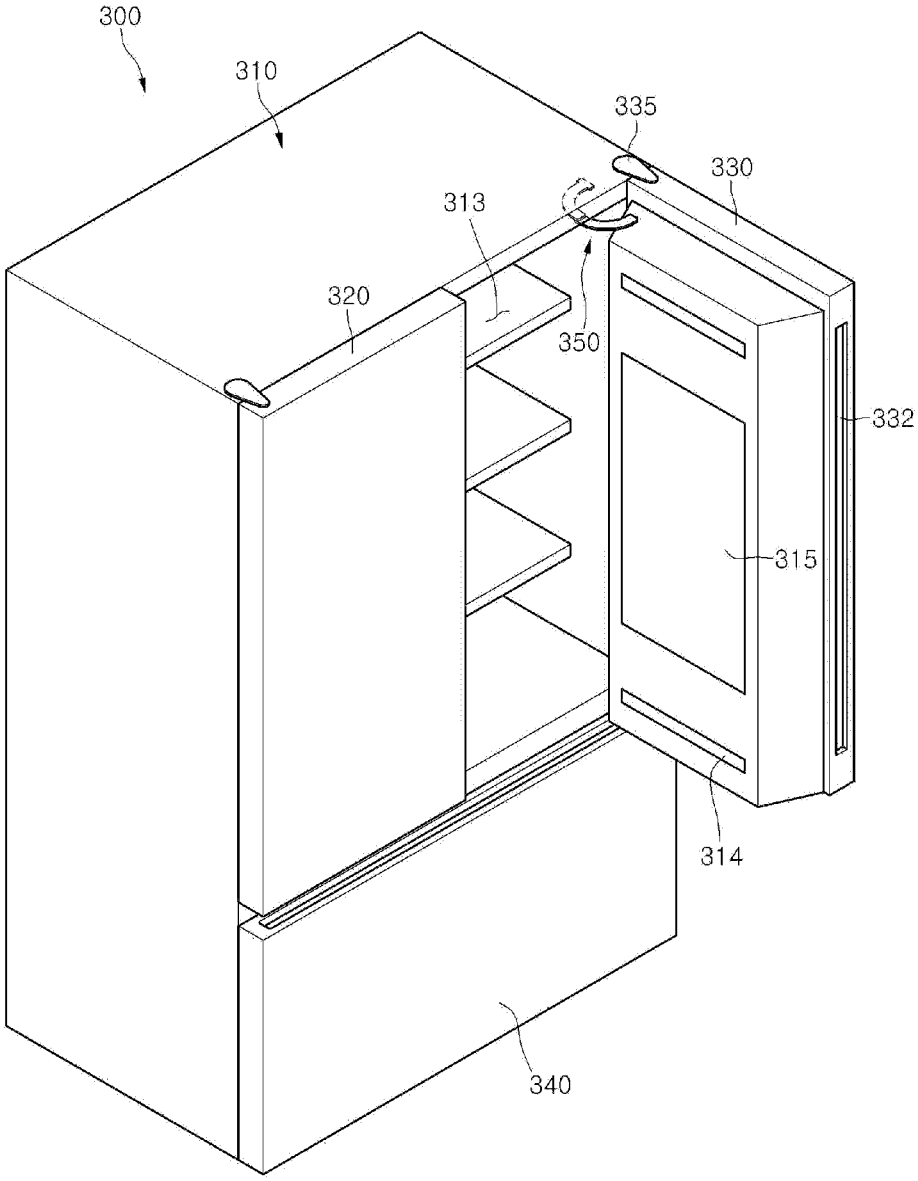
FIG. 6 is a perspective view of the refrigerator in the state where the refrigerator door and a housing according to the second embodiment is opened together.

FIG. 5 is a perspective view of a refrigerator in the state where only a refrigerating chamber door according to the second embodiment is opened and FIG. 6 is a perspective view of a refrigerator in the state where a refrigerating chamber door and a housing according to the second embodiment is opened together.

Referring to FIGS. 5 and 6, a refrigerator 300 according to the present embodiment includes a main body 310 in which a refrigerating chamber 311 and a freezing chamber (not shown) are formed to be partitioned up and down, a plurality of refrigerating chamber doors 320 and 330 that opens and closes the refrigerating chamber 311, a freezing chamber door 340 that opens and closes the freezing chamber.

In the present embodiment, the refrigerating chamber, which is formed at the main body 310, may be referred to as a "main refrigerating chamber".

Refrigerating chamber doors 320 and 330 is rotatably supported to the main body by the first hinge assembly 335. The first hinge assembly 335 can be disposed at the upper side and the lower side of the refrigerating chamber doors 320 and 330 as one example.

The main body 310 is movably connected to a housing 312 that defines a sub-refrigerating chamber 313 partitioned from the main refrigerating chamber 311. As one example, the housing 312 is rotatably connected and supported to the main body 310 by a plurality of second hinge assemblies 350.

One of the plurality of second hinge assemblies 350 may be positioned at the upper side of the housing 312 and the other may be positioned at the lower side of the housing 312.

One end of the second hinge assembly 350 may be connected to a side wall of the main refrigerating chamber 311 and the other may be connected to the upper side of the housing 312. A structure of the second hinge assembly 350 will be described below with reference to the drawings.

The housing 312 can be drawn out to the outside of the main body 310 (or main refrigerating chamber) together with any one (in the present embodiment, a right door 330) of the plurality of refrigerating chamber doors in the state where the housing 312 is positioned at the main body 310.

In other words, the housing 312 and the right door 330 are selectively coupled with each other by the coupling apparatus (as will be described below) and in the state where the housing 312 and the right door 330 are separated from each other, only the right door 330 is rotated to open the sub-refrigerating chamber 313 in the state where the housing 312 is positioned at the main body 310.

On the other hand, in the state where the housing 312 and the right door 330 are coupled with each other, the housing 312 is rotated together with the right door 330 to open the main refrigerating chamber 311.

The side surfaces of each of the refrigerating chamber doors 320 and 330 may be provided with the door groove 332 for providing the handle.

The housing 312 may be provided with one or more cool air injecting hole 314 that injects cool air into the main refrigerating chamber 311. In addition, the housing 312 can be provided with a cover 315 that can draw out or in foods stored in the sub-refrigerating chamber 313 in the state where the housing 312 is rotated together with the right door 330.

The sub-refrigerating chamber 313 can receive frequently used foods or foods for children, etc., as described in the first embodiment.

Figure 7:
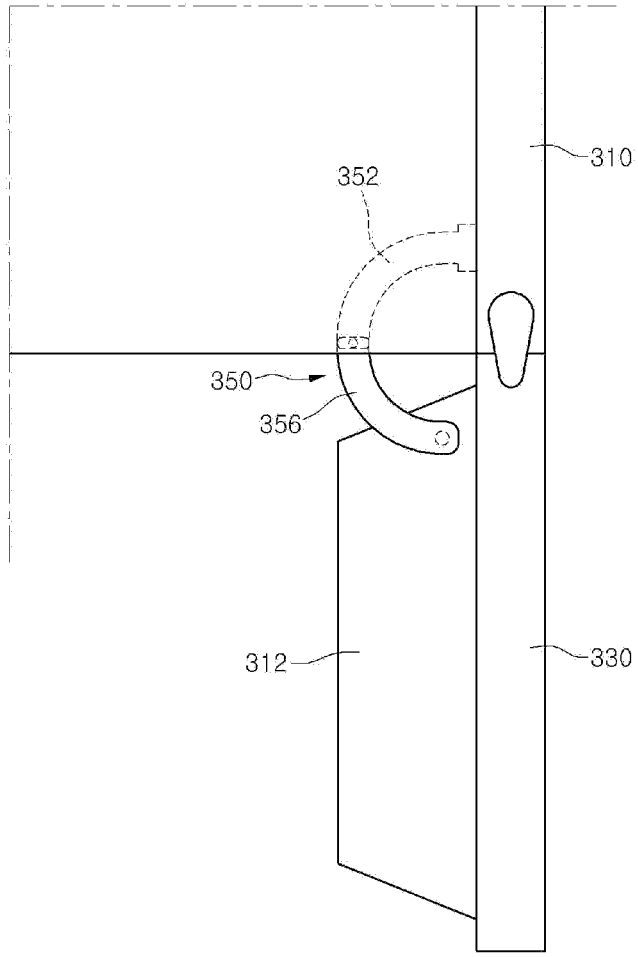
FIG. 7 is a diagram showing a structure of a second hinge assembly according to the second embodiment.
Figure 8:
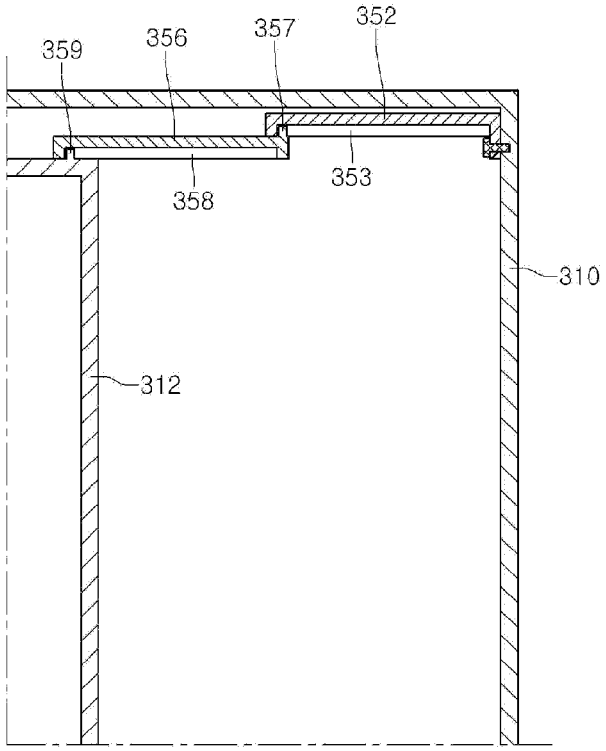
FIG. 8 is a cross-sectional view taken along line A-A of FIG. 7.

FIG. 7 is a diagram showing a structure of the second hinge assembly according to the second embodiment and FIG. 8 is a cross-sectional view taken along line A-A of FIG. 7.

Referring to FIGS. 7 and 8, the second hinge assembly 350 according to the present embodiment includes a first link 352 that is fixed to an inner side wall of the main body 310 and a second link 356 that is slidably connected to the first link 352.

The first link 352 may be coupled with the main body 310 by a coupling member such as a screw as one example. Each of the first link 352 and the second link 356 may be formed in a circular arc shape having approximately 90°.

The second link 356 is disposed at the lower side of the first link 352. The lower surface of the first link 352 is formed with the first guide groove 353 and the upper surface of the second link 356 is formed with a first guide protrusion 357 that is positioned at the first guide groove 353. The first guide protrusion 357 may be moved along the first guide groove 353.

In order to prevent the first guide protrusion 357 from being separated from the first guide groove 353, the first guide protrusion 357 and the second guide groove 353 may be formed in a "T" shape as one example.

The lower surface of the second link 356 is formed with the second guide groove 358 and the upper surface of the housing 312 is formed with the second guide protrusion 359. The second guide protrusion 359 plays a role of a rotational shaft of the housing 312 and may be moved along the second guide groove 358.

In order to prevent the second guide protrusion 359 from being separated from the second guide groove 358, the second guide protrusion 359 and the second guide groove 358 may be formed in a "T" shape as one example.

The second guide protrusion 359, which plays a role of the rotational shaft of the housing 312, can be moved by the first link 353 and the second link 356.

In other words, the second link 356 is overlapped with the first link 353 in the state where the housing 312 is positioned at the main body 310 and the second link 356 is sled and is drawn out from the main body 310 in the state where the housing 312 is drawn out to the outside of the main body 310.

As such, since the second guide protrusion 359 can be moved, the housing 312 can be rotated together with the refrigerating chamber door 330 in the state where the housing 312 is coupled with the refrigerating chamber door 330 even though the positions of the rotational center of the housing 312 and the rotational center of the first hinge assembly 335 are different from each other.

Although the present embodiment describes the case where the housing is rotated from the main body by two links by way of example, this is described only by way of example but is not limited to the structure of the second hinge assembly.

Figure 9:
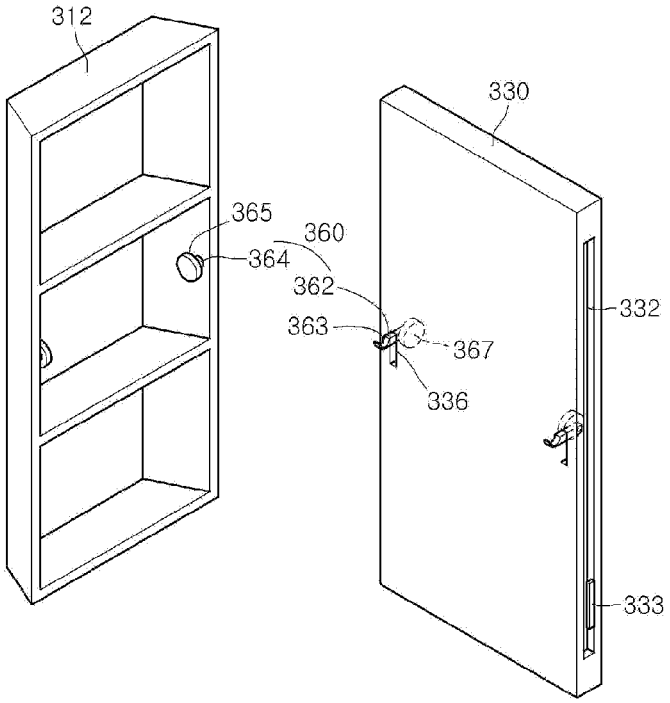
FIG. 9 is a perspective view showing a coupling structure of the refrigerator door and the housing according to the second embodiment.
Figure 10:
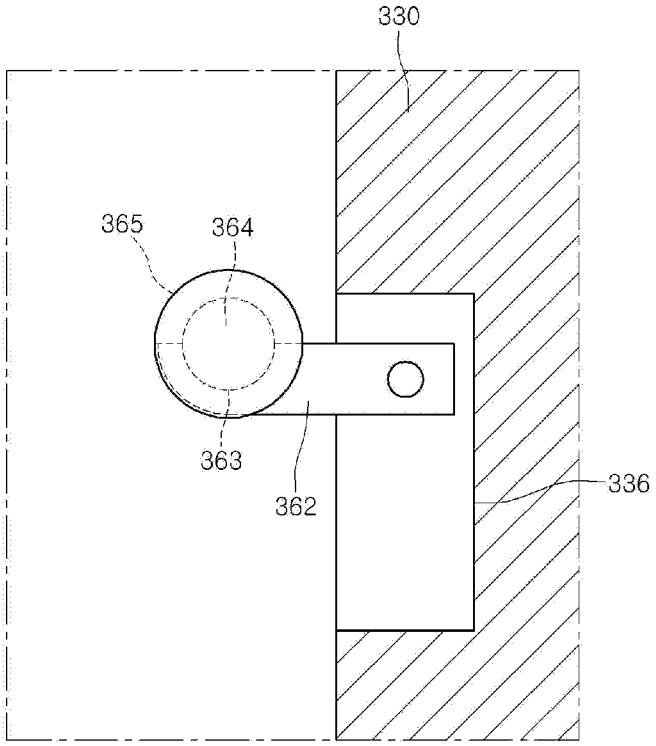
FIG. 10 is a diagram showing a state where the housing and the refrigerating chamber door are coupled with each other.

FIG. 9 is a perspective view showing a coupling structure of the housing and the refrigerating chamber door according to the second embodiment and FIG. 10 is a diagram showing the state where the housing and the refrigerating chamber door are coupled with each other.

Referring to FIGS. 9 and 10, the housing 312 and the refrigerating chamber door 330 can be selectively coupled by one or more coupling apparatuses 360 FIG. 9 shows the case where the plurality of coupling apparatuses 360 are provided, by way of example.

The coupling apparatus 360 includes a first coupling part 362 that is provided at the refrigerating chamber door 330, a second coupling part 364 that is provided at the housing 312 and is coupled with the first coupling part 362, and a driver 367 that drives the first coupling part 362.

The first coupling part 362 is received in a receiving part 336 that is formed at the rear surface of the refrigerating chamber door 330. The first coupling part 362 is connected to the driver 367 and is selectively rotated by the driver 367.

The first coupling part 362 is formed with a coupling groove 363 to which the second coupling part 364 is hung. The second coupling part 364 is seated to the second coupling groove 363 in the state where the first coupling part 362 is rotated in one direction (a direction coupled with the second coupling part). In other words, the first coupling part 362 supports the second coupling part 364.

Therefore, the load of the housing 312 may be supported by the second hinge assembly 350 and the coupling apparatus 360 in the state where the housing 312 is rotated together with the refrigerating chamber door 330.

The second coupling part 364 is formed in a cylindrical shape as one example and is selectively seated to the second coupling groove 363. The end portion of the second coupling part 364 may be formed with a separating prevention part 365 having a diameter larger than a diameter of the second coupling part 364 so that the coupling state of the second coupling part 364 and the first coupling part 362 is stably maintained.

The driver 367 may be operated by an operating part 333 that is provided at the door groove 332. In other words, when the operating part 333 is pressed once, the driver is rotated in one direction such that the first coupling part 362 and the second coupling part 364 are coupled with each other.

On the other hand, when the refrigerating chamber door 330 is closed without operating the operating part 333, the driver 367 is rotated in an opposite direction such that the coupling of the first coupling part 362 and the second coupling part 364 is released. The opening and closing of the refrigerating chamber door 330 can be sensed by the sensor that is not shown.

At this time, although the operating part 333 is operated in the state where the refrigerating chamber door 330 is opened and the first coupling part 362 and the second coupling part 364 are coupled, the driver 367 is not operated.

This is to prevent the housing 312 from being separated from the refrigerating chamber door 330 in the state where the housing 312 and the refrigerating chamber door 330 are opened together.

In the present embodiment, it is noted that the position of the operating part 333 is illustrated by way of example and the position thereof is not limited. As one example, the operating part 333 may be provided at the front surface of the refrigerating chamber door 330.

In addition, it is noted that the structure of the coupling apparatus 360 is not limited to the present embodiment but various structures can be used.

Figure 11:
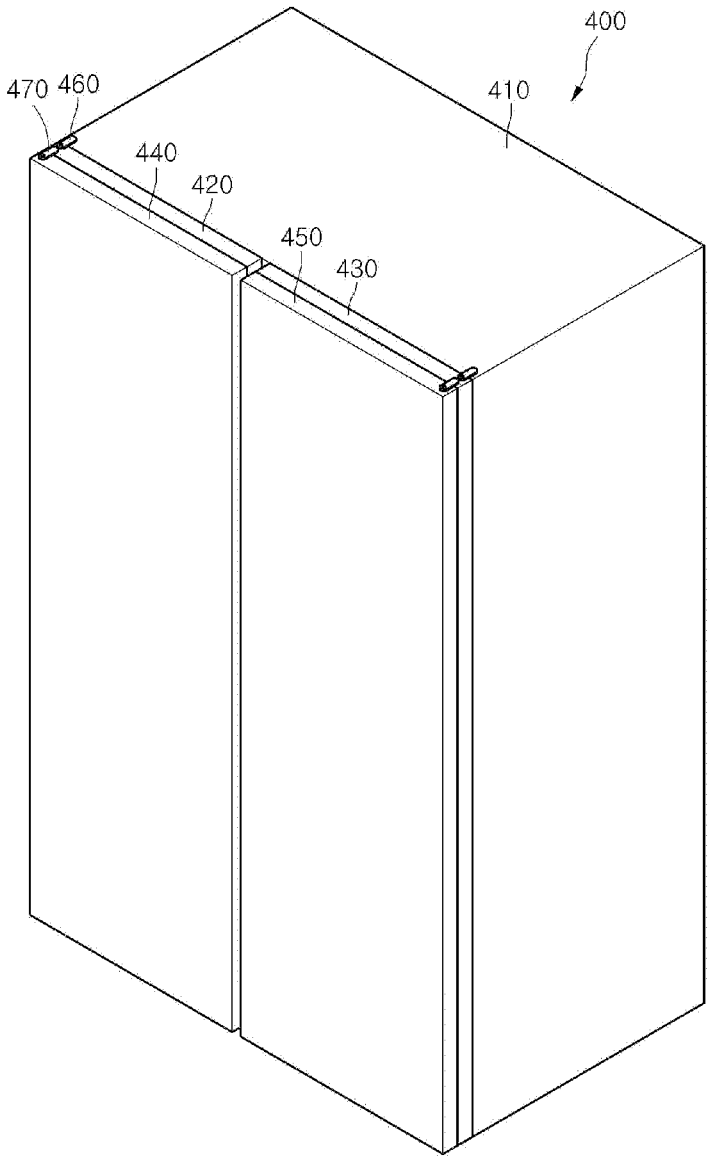
FIG. 11 is a perspective view of a refrigerator according to a third embodiment.
Figure 12:
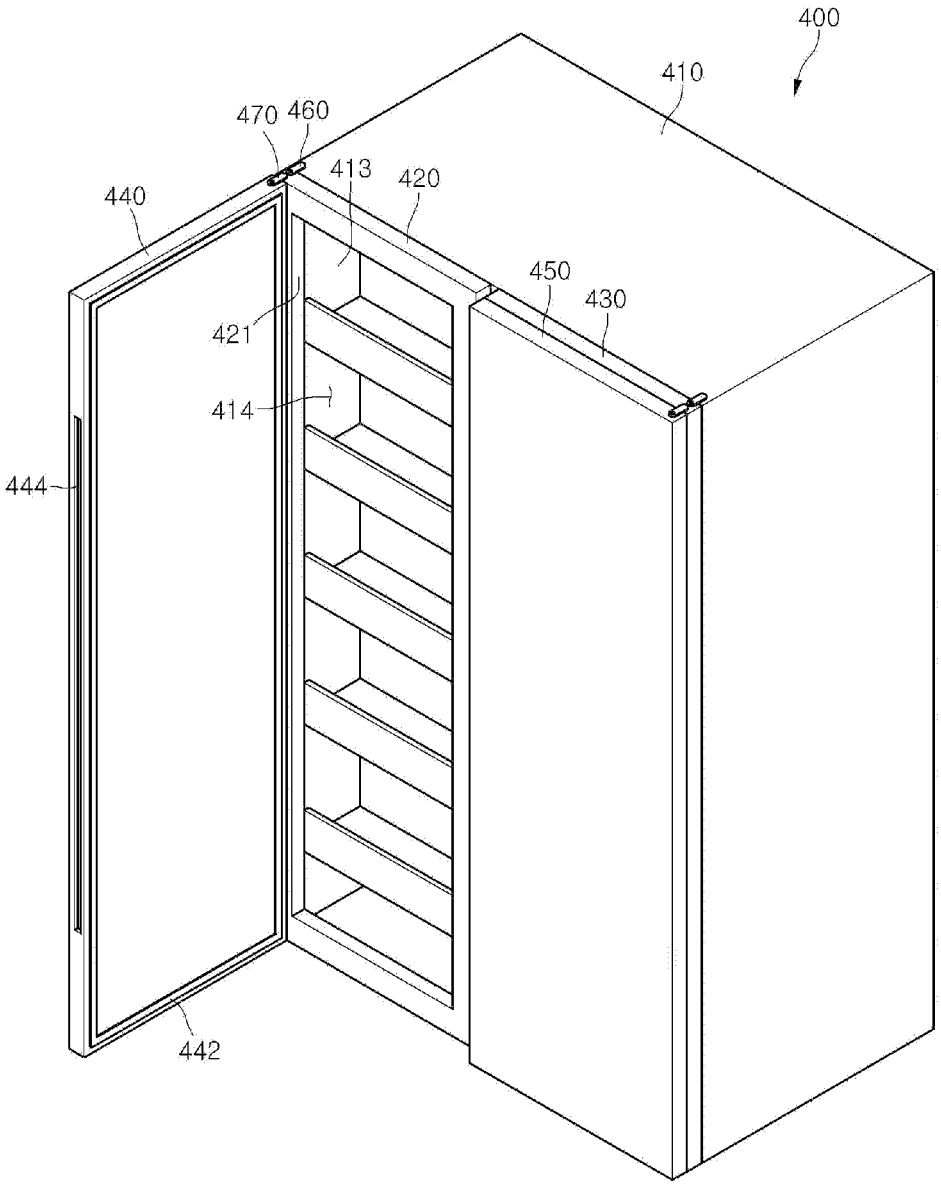
FIG. 12 is a perspective view of a refrigerator in the state where the freezing chamber door according to the third embodiment is opened.
Figure 13:
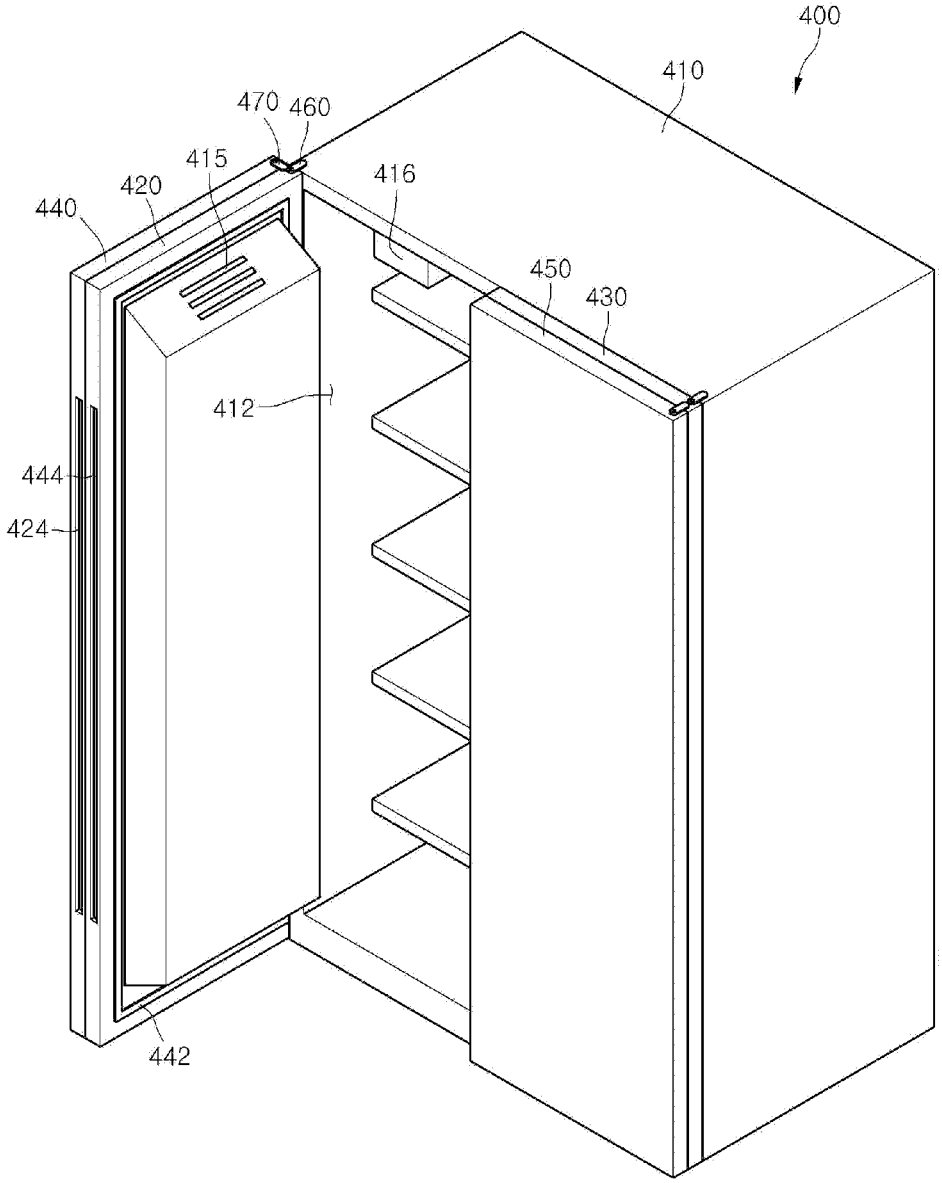
FIG. 13 is a perspective view of a refrigerator in the state where a refrigerating chamber door and a freezing chamber door according to the third embodiment are opened.

FIG. 11 is a perspective view of a refrigerator according to a third embodiment, FIG. 12 is a perspective view of a refrigerator in the state where a refrigerating chamber door according to the third embodiment is opened, and FIG. 13 is a perspective view of a refrigerator in the state where the refrigerating chamber door and the freezing chamber door according to the third embodiment are opened together.

Referring to FIGS. 11 to 13, a refrigerator 400 of the present embodiment includes a main body 410 in which a refrigerating chamber 412 is formed, a plurality of refrigerating chamber doors 420 and 430 for opening and closing the refrigerating chamber 414, a housing 413 that is provided at the refrigerating chamber doors 420 and 430 and forms the freezing chamber 414, and a plurality of freezing chamber doors 440 and 450 that is rotatably coupled with each of the refrigerating chamber doors 420 and 430 to open and close the freezing chamber 414.

In the present embodiment, the case where the refrigerating chamber door is disposed left and right is described as one example and the structure of the left refrigerating chamber door and the structure of the right refrigeration door are the same, and therefore, only the left refrigerating chamber door will be described below by referring reference numerals thereto.

The housing 413 is coupled to a rear surface of the refrigerating chamber door 420. In the present embodiment, the housing 413 moves the refrigerating chamber door 420 together in the state where the housing 413 is fixed to the refrigerating chamber door and therefore, the case where the freezing chamber 414 is formed at the refrigerating chamber door 420 can be also described.

Therefore, with the present embodiment, the freezing chamber 414 is selectively positioned inside the refrigerating chamber 412 according to whether the refrigerating chamber door 420 is opened.

The refrigerating chamber door 420 is formed with an opening part 421 that can draw out and in foods. Therefore, foods are received in the freezing chamber 414 or are drawn out of the refrigerating chamber 414 through the opening part 421.

The freezing chamber door 440 opens and closes the opening part 421 (or freezing chamber) in the state where it is positioned at the front of the refrigerating chamber door 420. In other words, when viewed from the upper surface of the refrigerator 400, the freezing chamber door 440 and the refrigerating chamber door 420 are disposed in a row in front and rear directions of the refrigerator.

The freezing chamber door 440 forms the entire external appearance of the front surface of the refrigerator. Therefore, the user can view only the front surface of the freezing chamber door 400 from the outside. However, the entire surface of the freezing chamber door and a portion surface of the refrigerating chamber door 420 can be viewed from the outside by making the size of the freezing chamber door 440 smaller than the size of the refrigerating chamber door 420.

The upper side of the housing 413 is formed with an evaporator (not shown) and one or more cool air injecting hole 415 into which heat-exchanged cool air is injected. The inner upper surface of the main body 410 is provided with a cool air duct 416 that forms a channel of a cool air.

Meanwhile, the refrigerating chamber door 420 is rotated with respect to the main body 410 by the first hinge assembly 460 and the freezing chamber door 440 can be rotated with respect to the refrigerating chamber door 420 by the second hinge assembly 470.

Therefore, the refrigerating chamber door 420 and the freezing chamber door 440 can be rotated independently without interference with each other by each of the hinge assemblies 460 and 470.

Meanwhile, the rear surface of the refrigerating chamber door 420 is provided with a sealer 422 for preventing a leakage of cool air from the refrigerating chamber 412 and the inner side of the sealer 422 may be provided with a magnet (not shown) for coupling with the main body 410.

In addition, the rear surface of the freezing chamber door 440 is provided with a sealer 422 for preventing a leakage of cool air from the freezing chamber 414 and the inner side of the sealer 422 may be provided with a magnet (not shown) for coupling with the refrigerating chamber door 420. The magnetic force of the magnet of the freezing chamber door 440 is smaller than the magnetic force of the magnet of the refrigerating chamber door 420.

Each of the side surfaces of the refrigerating chamber door 420 and the freezing chamber door 440 is formed with door grooves 424 and 444 for providing handles.

Therefore, when the freezing chamber door 420 is pulled in the state where the user's hand puts in the door home 424 of the refrigerating chamber door 420, the refrigerating chamber door 420 is rotated in the state where the freezing chamber door 440 is coupled with the refrigerating chamber door 420, such that the refrigerating chamber 412 is opened.

When the refrigerating chamber door 440 is pulled in the state where the user's hand puts in the door home 444 of the freezing chamber door 440, the magnetic force of the magnet of the refrigerating chamber door 420 is larger than the magnetic force of the magnet of the freezing chamber door 440, such that only the freezing chamber door 440 is rotated in the state where the refrigerating chamber door 420 is coupled with the main body to open the freezing chamber 414.

With the above-mentioned embodiment, the refrigerating chamber 412 is formed in the entire space of the main body 410 and the freezing chamber 414 formed at the freezing chamber door 440 can be positioned inside the refrigerating chamber 412, such that the volume of the refrigerating chamber 412 can be formed as large as possible.

Unlike this, in order to make the volume of the freezing chamber large, the freezing chamber can be formed at the main body and the refrigerating chamber can be formed at the door. In this case, the refrigerating chamber is formed at the freezing chamber door and the refrigerating chamber is positioned at the front of the freezing chamber door.

In the above-mentioned embodiments, the freezing chamber or the refrigerating chamber formed at the main body may be referred to as the first storage chamber and the refrigerating chamber or the freezing chamber, which is selectively received in the first storage chamber by the housing provided at the main body, may be referred to as the second storage chamber. Thereby, the first storage chamber and the second storage chamber are the refrigerating chamber or the freezing chamber and any one thereof may be the refrigerating chamber or the other thereof may be the freezing chamber.

What is claimed is:

1. A refrigerator, comprising:

a main body having a first storage area in which a first plurality of shelves are arranged vertically;

a main door rotatably coupled to a front of the main body, the main door configured to be in close contact with a front surface of the main body when the main door is in a closed position;

a sub door rotatably coupled to a front of the main door, the sub door configured to be in close contact with a front surface of the main door when the sub door is in a closed position;

a first hinge assembly which connects an upper surface of the main door and an upper surface of the main body; and a second hinge assembly which connects an upper surface of the sub door and the upper surface of the main door, wherein the main door includes:

a second storage area in which a second plurality of shelves are arranged vertically;

an opening part which enables access to the second storage area; and a main door side magnet provided such that the main door is in close contact with the front surface of the main body, wherein the sub door includes a sub door side magnet provided such that the sub door is in close contact with the main door, wherein handles are respectively formed in the main door and the sub door extending in length directions of the doors, such that the main door and the sub door rotate in the same direction to be opened, wherein the sub door is provided in such a manner that the sub door covers a region where the handle of the main door is formed at a front side of the main door, wherein the handle of the main door or the handle of the sub door is configured to be selectively accessible, wherein at least a portion of an upper surface of the sub door and at least a portion of an upper surface of the main door are substantially coplanar, wherein a side surface of the main body, a side surface of the main door and a side surface of the sub door are substantially coplanar; and wherein the magnetic force of the magnet on the main door is configured to be greater than the magnetic force of the magnet on the sub door.

2. The refrigerator according to claim 1, further comprising:

a main door side sealer disposed at the main door and accommodating the main door side magnet thereinside; and a sub door side sealer disposed at the sub door and accommodating the sub door side magnet thereinside.

3. The refrigerator according to claim 1, further comprising a housing provided at a rear surface of the main door, wherein the housing is configured to separate the second storage area from the first storage area.

4. The refrigerator according to claim 3, wherein the refrigerator is configured such that the temperature of the second storage area is different from the temperature of the first storage area.

5. The refrigerator according to claim 4, wherein the first storage area includes a refrigerating chamber, and the second storage area includes a refrigerating chamber or a freezing chamber.

6. The refrigerator according to claim 1, wherein the handle of the sub door is a door groove which is recessed in a predetermined depth.

7. The refrigerator according to claim 1, wherein the handle of the main door is a door groove which is recessed in a predetermined depth.

8. The refrigerator according to claim 1, wherein a groove for putting in a user's hand is formed in the handle of the main door.

9. The refrigerator according to claim 1, further comprising a third door in close contact with the main body, wherein the third door includes a handle which faces the handle of the main door.

10. The refrigerator according to claim 1, wherein the sub door is located in front of the handle of the main door in a state in which the sub door is closed, to be accessible to the handle of the main door via a side surface of the sub door.

11. The refrigerator according to claim 1, further comprising a coupling apparatus selectively coupling the main door and the sub door.

12. The refrigerator according to claim 1, further comprising:

magnets respectively mounted on rear surfaces of the main door and the sub door, the magnetic force of the magnet on the main door configured to be greater than the magnetic force of the magnet on the sub door; and a coupling apparatus selectively coupling the main door with the sub door, wherein when the coupling apparatus is uncoupled, the sub door is separable from the main door.

13. The refrigerator according to claim 11, wherein the coupling apparatus includes a latch hook.

14. The refrigerator according to claim 12, wherein the coupling apparatus includes a latch hook.

15. A refrigerator, comprising:

a main body having a first storage area in which a first plurality of shelves are arranged vertically;

a main door rotatably coupled to a front of the main body, the main door configured to be in close contact with a front surface of the main body when the main door is in a closed position;

a sub door rotatably coupled to a front of the main door, the sub door configured to be in close contact with a front surface of the main door when the sub door is in a closed position;

a first hinge assembly which connects an upper portion of the main door and an upper portion of the main body; and a second hinge assembly which connects an upper portion of the sub door and the upper portion of the main door, wherein the main door includes:

a second storage area in which a second plurality of shelves are arranged vertically;

an opening part which enables access to the second storage area and having a size corresponding to an opened part of the first storage area; and a main door side magnet provided such that the main door is in close contact with the front surface of the main body, wherein the sub door includes a sub door side magnet provided such that the sub door is in close contact with the main door, wherein handles are respectively formed in the main door and the sub door extending in length directions of the doors, such that the main door and the sub door rotate in the same direction to be opened, wherein the sub door is provided in such a manner that the sub door covers a region where the handle of the main door is formed at a front side of the main door, wherein the handle of the main door or the handle of the sub door is configured to be selectively accessible, wherein at least a portion of an upper surface of the sub door and at least a portion of an upper surface of the main door are substantially coplanar, wherein a side surface of the main body, a side surface of the main door and a side surface of the sub door are substantially coplanar; and wherein the magnetic force of the magnet on the main door is configured to be greater than the magnetic force of the magnet on the sub door.

* * * * *